United States Patent [19]

Provost

[11] 4,308,948

[45] Jan. 5, 1982

[54] PAPERBOARD DISPLAY STAND

[75] Inventor: John G. Provost, Stoneham, Mass.

[73] Assignee: Container Corporation of America, Chicago, Ill.

[21] Appl. No.: 194,077

[22] Filed: Oct. 6, 1980

[51] Int. Cl.[3] ..... B65D 5/52; B65D 25/24

[52] U.S. Cl. ..... 206/45.25; 229/16 D

[58] Field of Search ..... 206/45.24, 45.25, 45.26; 248/198, 174; 229/16 D

[56] References Cited

U.S. PATENT DOCUMENTS

| | | | |
|---|---|---|---|
| 1,407,526 | 2/1922 | Glover | 206/45.26 |
| 2,229,257 | 1/1941 | Reaume | 229/16 D |
| 2,940,710 | 6/1960 | Adams | 229/16 D |
| 3,000,546 | 8/1961 | Catri | 229/16 D |
| 3,322,264 | 5/1967 | McNair et al. | 206/45.25 |
| 3,918,576 | 11/1975 | Taub | 229/16 D |
| 4,049,114 | 8/1977 | Danheisser | 206/45.25 |

*Primary Examiner*—Joseph Man-Fu Moy

*Attorney, Agent, or Firm*—R. W. Carpenter; Davis Chin

[57] ABSTRACT

A display stand formed from a unitary blank of paperboard and having integral base, tray and riser portions.

5 Claims, 3 Drawing Figures

PAPERBOARD DISPLAY STAND

SUMMARY OF THE INVENTION

This invention relates to display stands and more particularly to a one-piece paperboard display stand having a tray portion supported by an integral base portion.

It is an object of the invention to provide, in a display stand of the type described a one-piece construction which can be shipped flat and easily erected from a tubular structure into a display stand having a tray portion supported by a base portion.

A more specific object of the invention is to provide a collapsible display stand of the type described wherein the tray portion has interlocking engagement with support elements of the base portion.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 2:
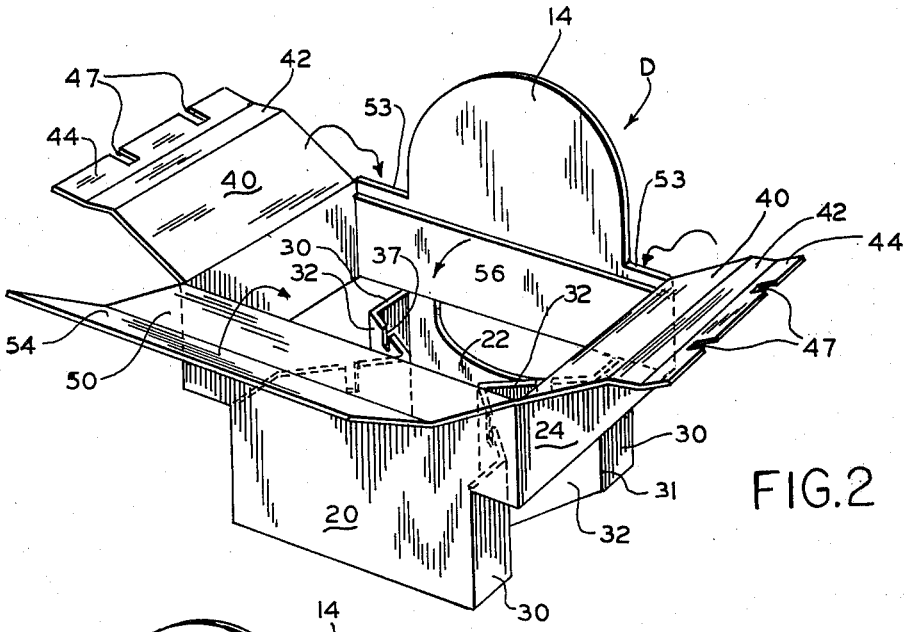
FIG. 2 is a view similar to FIG. 1 but illustrating the manner in which the stand is assembled.
Figure 1:
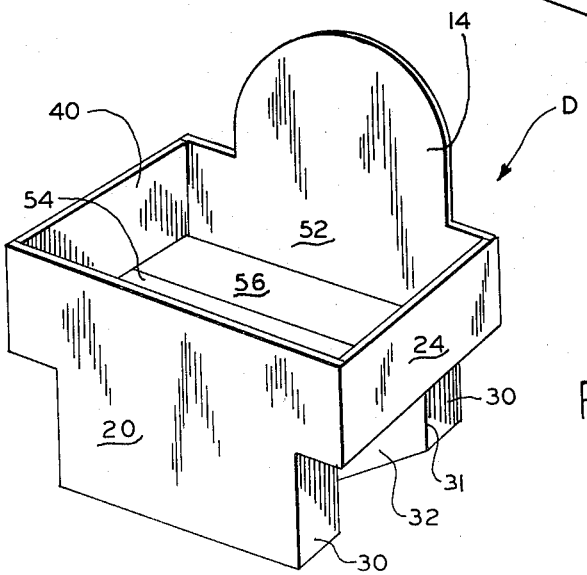
FIG. 1 is a paperboard display stand embodying features of the invention and shown in the erected condition.

Referring now to the drawings for a better understanding of the invention, it will be seen that the one-piece bin-type display stand indicated generally at D in FIGS. 1 and 2, may be formed from a unitary blank B of foldable sheet material, illustrated in FIG. 1. Display stand D includes a tray portion 10 supported by an integral base portion 12 and having an integral riser 14 extending upwardly therefrom and adapted to carry an advertising message.

As best seen in FIGS. 1 and 2 the tray portion or member 10 includes a pair of opposed front and rear wall panels 20 and 22, respectively which also serves as front and rear walls for the base member 12, as hereinafter described.

Front and rear wall panels 20 and 22 are interconnected by a pair of outer side panels 24 which are foldably joined at their opposite end edges along fold lines 25 to adjacent side edges of front and rear wall panels 20 and 22, respectively.

As previously mentioned, the front and rear walls of base member 12 are really lower extensions of tray member front and rear wall panels 20 and 22, respectively.

Additionally, base member 12 includes opposed pairs of edge panels 30 located on each side of the base. Each pair of edge panels 30 are foldably joined at their outer edges on fold lines 31 to the adjacent side edges of front and rear wall panels 20 and 22, respectively. Positioned between each pair of edge panels 30 are a pair of support panels 32 which are foldably joined at their outer edges along fold lines 33 to the inner edges of adjacent edge panels 30. Support panels 32 are disposed to converge inwardly where they are joined to each other along a fold line 35.

Thus, it will be seen that as each pair of support panels 32 converge inwardly toward each other they form a V-shaped structure which supports the tray member 10 of display stand D. The upper edges of each of the support panels 32 is provided with a recess or notch 37 adapted to mate with the related portion of the tray structure in a manner hereinafter described.

Figure 3:
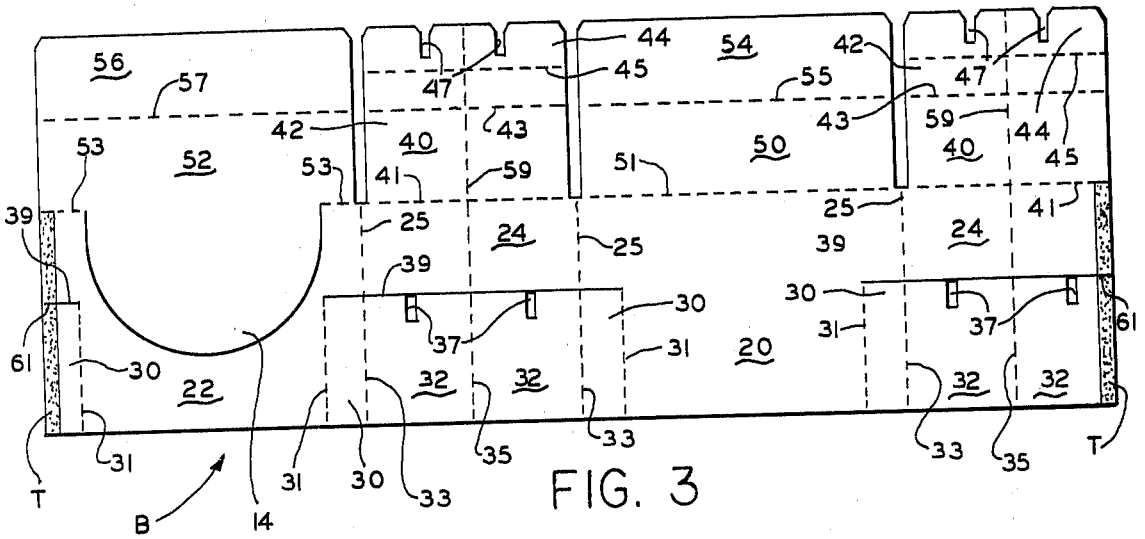
FIG. 3 is a plan view of a blank of foldable sheet material from which the display stand illustrated in the other views may be formed.

As best seen in FIG. 3 base member edge panels 30 and support panels 32 are separated from tray member side walls 24 and from portions of the tray member front and rear walls 20 and 22 by cut lines 39. Cut lines 39 are preferably not complete cut lines but contain nicks to hold the adjacent portions of the structure together until it is ready to be assembled at which point the nicks are broken and the two portions are separated from each other.

As best seen in FIG. 3 a pair of inner side panels 40 are foldably joined at their upper edges along fold lines 41 to the upper edges of tray outer side panels 24 and are folded in face-to-face relationship with the respective tray member side panels 24 to provide a two-ply side wall for the tray member. A pair of relatively narrow ledge panels 42 are foldably joined at their outer edges along fold lines 43 to the lower edges of inner side panels 40. Ledge panels 42 are folded inwardly at right angles to their related side walls so as to assume a horizontal position over the support panels 32. A pair of opposed locking panels 44 are foldably joined along fold lines 45 to the inboard edges of respective ledge panels 42. Locking panels 44 are folded downwardly at right angles to their respective ledge panels and are provided with recesses or notches 47 adapted to interlock with related notches 37 in adjacent support panels 32. Thus, an interlocking relationship is provided between the tray and base members to maintain the display stand in erected condition.

Tray member front and rear wall inner panels 50 and 52 are foldably joined at their upper edges along fold lines 51 and 53 to the upper edges of front and rear wall panels 20 and 22, respectively and are folded downwardly in face-to-face relation with the inside surfaces of front and rear wall panels 20 and 22.

To provide a floor or bottom wall for tray member 20 there are provided a pair of front and rear bottom panels 54 and 56 which are foldably joined along fold lines 55 and 57 to a lower edge of tray front inner wall panel 50 and a lower edge of the tray inner rear wall panel 52, respectively. Thus, it will be seen that bottom panels 54 and 56 are disposed in coplanar relationship and supported by ledge panels 42 and support panels 32 to provide a floor for the tray so that it can be used for holding articles to be displayed.

As previously mentioned the display stand D is formed from a blank B of paperboard as illustrated in FIG. 3. After the blank has been manufactured the opposite ends of the blank are secured together as by tape T to form a manufacturer's joint. In order to collapse the carton into tubular configuration for shipping a pair of score lines 59 are provided, best seen in FIG. 3. The sole function of these score lines is to accommodate folding the blank for forming the manufacturer's joint and shipping in a collapsed condition.

In order to erect the carton, it is desirable to make cut lines in the tape as shown at 61; these cut lines are a continuation of cut lines 39 which separate the support panels from the side panels of the tray member.

After this has been done the tray portion of the container as well as the base portion are folded to form a tube as shown in FIG. 2. The support panels are then pushed inwardly as shown in FIG. 2 and the front, rear, and side inner panels are folded downwardly with the locking panels positioned in interlocking engagement with the support.

The tray bottom wall panels are then folded donwardly into position and the tray is in completely erected condition and ready to be used as a display stand for holding articles to be displayed and sold.

It will be understood that when tray inner wall panel 52 is folded downwardly 180 degrees against rear wall 22, riser 14, which is an extension of panel 52, will project upwardly above the tray member.

I claim:

1. A collapsible display stand, formed from a unitary blank of foldable sheet material such as paperboard, comprising:

(a) a tray member including opposed pairs of front and rear walls and side walls foldably interconnected to form a tubular structure;

(b) a base member including:

(i) a pair of opposed front and rear walls, which are lower extensions of said tray member front and rear walls;

(ii) a pair of opposed side structures extending between and interconnecting said front and rear walls and each including a pair of inwardly converging support panels foldably joined to each other;

(c) said tray member also including:

(i) first panel means foldably joined to said side panels and having interlocking engagement with said support panels for maintaining said device in erected condition;

(ii) second panel means foldably joined to said front and rear walls and disposed to overlie and be supported by said support panels to form a bottom wall for said tray member.

2. A display stand according to claim 1, and including a riser panel formed from material cut from said rear wall and folded 180° with respect thereto to extend upwardly therefrom above said tray member.

3. A display stand according to claim 1, wherein each of said base member side structures also includes a pair of co-planar edge panels spaced from each other and being foldably joined at their outer edges to adjacent side edges of respective front and rear walls, and being foldably joined at their inner edges to adjacent edges of related support panels.

4. A display stand according to claim 1, wherein said first panel means includes:

(a) a pair of inner side wall panels foldably joined at their upper edges to upper edges of related side walls and folded inwardly in face-to-face relation therewith;

(b) a pair of ledge panels foldably joined at their outer edges to lower edges of respective inner side wall panels and extending inwardly therefrom and normal thereto;

(c) a pair of locking flaps foldably joined at their upper edges to inner edges of respective ledge panels and folded downwardly into interlocking engagement with upper portions of respective support panels.

5. A display stand according to claim 1, wherein said second panel means includes:

(a) a pair of inner front and rear wall panels foldably joined at their upper edges to upper edges of respective front and rear walls and folded inwardly in face-to-face relation therewith;

(b) a pair of co-planar bottom wall panels foldably joined at their outer edges to lower edges of respective inner front and rear wall panels and extending inwardly therefrom to provide a floor for said tray member.

* * * * *